US009115938B2

(12) United States Patent
Alahyari et al.

(10) Patent No.: US 9,115,938 B2
(45) Date of Patent: Aug. 25, 2015

(54) TWO-PHASE DISTRIBUTOR

(75) Inventors: Abbas A. Alahyari, Manchester, CT (US); Miad Yazdani, Oak Park, IL (US); Thomas D. Radcliff, Vernon, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 418 days.

(21) Appl. No.: 13/528,352

(22) Filed: Jun. 20, 2012

(65) Prior Publication Data

US 2013/0340984 A1 Dec. 26, 2013

(51) Int. Cl.
*F28F 9/02* (2006.01)
*F25B 39/02* (2006.01)

(52) U.S. Cl.
CPC ..... *F28F 9/0273* (2013.01); *F25B 39/028* (2013.01); *Y10T 29/4935* (2015.01)

(58) Field of Classification Search
CPC ..... F28F 9/0202; F28F 9/0207; F28F 9/0209; F28F 9/0212; F28F 9/0214; F28F 9/0268; F28F 9/0278; F28F 9/0287; F28F 9/28; F28F 9/027; F25B 39/028; Y10T 29/4935
USPC ..... 165/100, 114, 174, 158, 139; 55/392
See application file for complete search history.

(56) References Cited

U.S. PATENT DOCUMENTS

| | | | | | |
|---|---|---|---|---|---|
| 2,099,186 | A | * | 11/1937 | Anderegg | 165/110 |
| 3,315,738 | A | * | 4/1967 | Jones, Jr. | 165/134.1 |
| 5,284,203 | A | * | 2/1994 | Dauvergne | 165/174 |
| 5,415,223 | A | * | 5/1995 | Reavis et al. | 165/96 |
| 5,979,547 | A | * | 11/1999 | Shinmura et al. | 165/174 |
| 6,082,448 | A | * | 7/2000 | Haussmann | 165/174 |
| 6,199,401 | B1 | * | 3/2001 | Haussmann | 62/525 |
| 6,948,559 | B2 | | 9/2005 | Reinke et al. | |
| 7,461,687 | B2 | * | 12/2008 | Han et al. | 165/103 |
| 2010/0206535 | A1 | | 8/2010 | Munoz et al. | |
| 2011/0017438 | A1 | | 1/2011 | Huazhao et al. | |

OTHER PUBLICATIONS

"Heat Exchanger"; Wikipedia, http://en.wikipedia.org/wiki/Heat_exchanger; p. 1-12; downloaded on Mar. 20, 2012.
FR Office Action for application FR 13 55734, mailed Oct. 1, 2013, 3 pages.

* cited by examiner

*Primary Examiner* — Tho V Duong
(74) *Attorney, Agent, or Firm* — Cantor Colburn LLP

(57) ABSTRACT

A heat exchanger is described comprising a distributor having an outer housing and including a plurality of substantially parallel plates disposed within the housing and configured to partition an input two-phase flow into a series of primarily single-phase layers. A heat exchanger is described comprising a distributor having an outer housing including a plurality of substantially parallel channels disposed therein, each channel configured to uniformly and independently convey a portion of a homogenous input two-phase flow from an input of the distributor to an output of the distributor.

5 Claims, 5 Drawing Sheets

TWO-PHASE DISTRIBUTOR

BACKGROUND

A heat exchanger may be used to provide for heat transfer from one medium to another. Heat exchangers may be used in a variety of application environments, such as refrigeration, air conditioning, power plants, petrochemical plants, petroleum refineries, gas processing, and sewage treatment.

A two-phase distribution (e.g., a distribution of both liquid and vapor) inside heat exchanger headers has posed a challenge. One environment in which such a challenge is present is in connection with evaporators of air conditioning units. Two-phase flow has been distributed using a closed-end tube with a series of holes in the side. An example of such a tube 102 is shown in FIG. 1. The tube 102 may include an open end 101, a closed-end 104 and a series of holes 106 between them. A two-phase flow may be inserted or injected into the tube via an opening. Such insertion/injection is shown via an arrow 108 in FIG. 1.

An assumption behind the tube 102 of FIG. 1 is that the flow of refrigerant entering the tube 102 at the open end 101 is annular and remains annular as it traverses the tube 102 towards the closed-end 104. If such an assumption held, a (near) uniform distribution of the two-phase refrigerant may be realized at the holes 106. In practice, the flow may tend to stratify as it traverses the tube 102 towards the closed-end 104. Such stratification may be a result of deceleration in the tube 102, and may be due to differences in mass between the liquid component and the vapor component of the two phases.

As a result of the stratification, the liquid component may tend to pool towards the closed-end 104 of the tube 102 in proximity to distal end holes 106*a*. Similarly, the vapor component may tend to pool and exit the tube 102 in proximity to the proximal end holes 106*b*. The non-ideal or non-uniform distribution of refrigerant that may be realized in actual practice may degrade the performance of the heat exchanger.

In order to address the issue of non-uniform distribution, the discharge holes 106 may be aligned at an angle, such as forty-five (45) degrees with respect to gravity. This approach, however, lacks robustness and is not universal for all operating conditions (e.g., quality and flow regimes).

BRIEF SUMMARY

An embodiment of the disclosure is directed to a heat exchanger comprising a distributor having an outer housing and including a plurality of substantially parallel plates disposed within the housing and configured to partition an input two-phase flow into a series of primarily single-phase layers.

An embodiment of the disclosure is directed to a heat exchanger comprising a distributor having an outer housing including a plurality of substantially parallel channels disposed therein, each channel configured to uniformly and independently convey a portion of a homogenous input two-phase flow from an input of the distributor to an output of the distributor.

An embodiment of the disclosure is directed to a method of manufacturing a distributor comprising forming an outer housing, and forming a plurality of substantially parallel plates within the outer housing to form a plurality of substantially parallel channels, each channel is configured to uniformly and independently convey a portion of a flow from an input of the outer housing to an output of the outer housing Additional embodiments are described below.

BRIEF DESCRIPTION OF THE DRAWINGS

The present disclosure is illustrated by way of example in the accompanying figures, in which.

DETAILED DESCRIPTION

Figure 1:
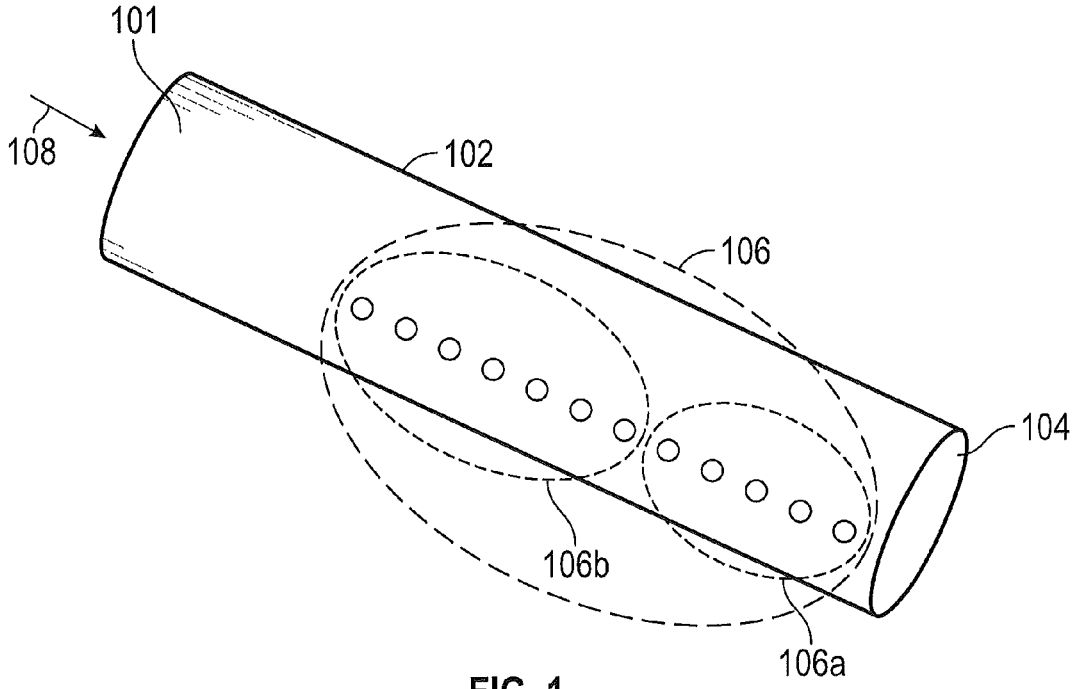
FIG. 1 (Prior Art)
FIG. 1 illustrates a tube of a heat exchanger according to the prior art.

Various aspects of this disclosure address a mal-distribution of refrigerant in a distributor tube of a heat exchanger. Tubes are described in accordance with various configurations and geometries. The tubes described herein are illustrative. Additional configurations and geometries are within the scope and spirit of this disclosure.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect.

Figure 2:
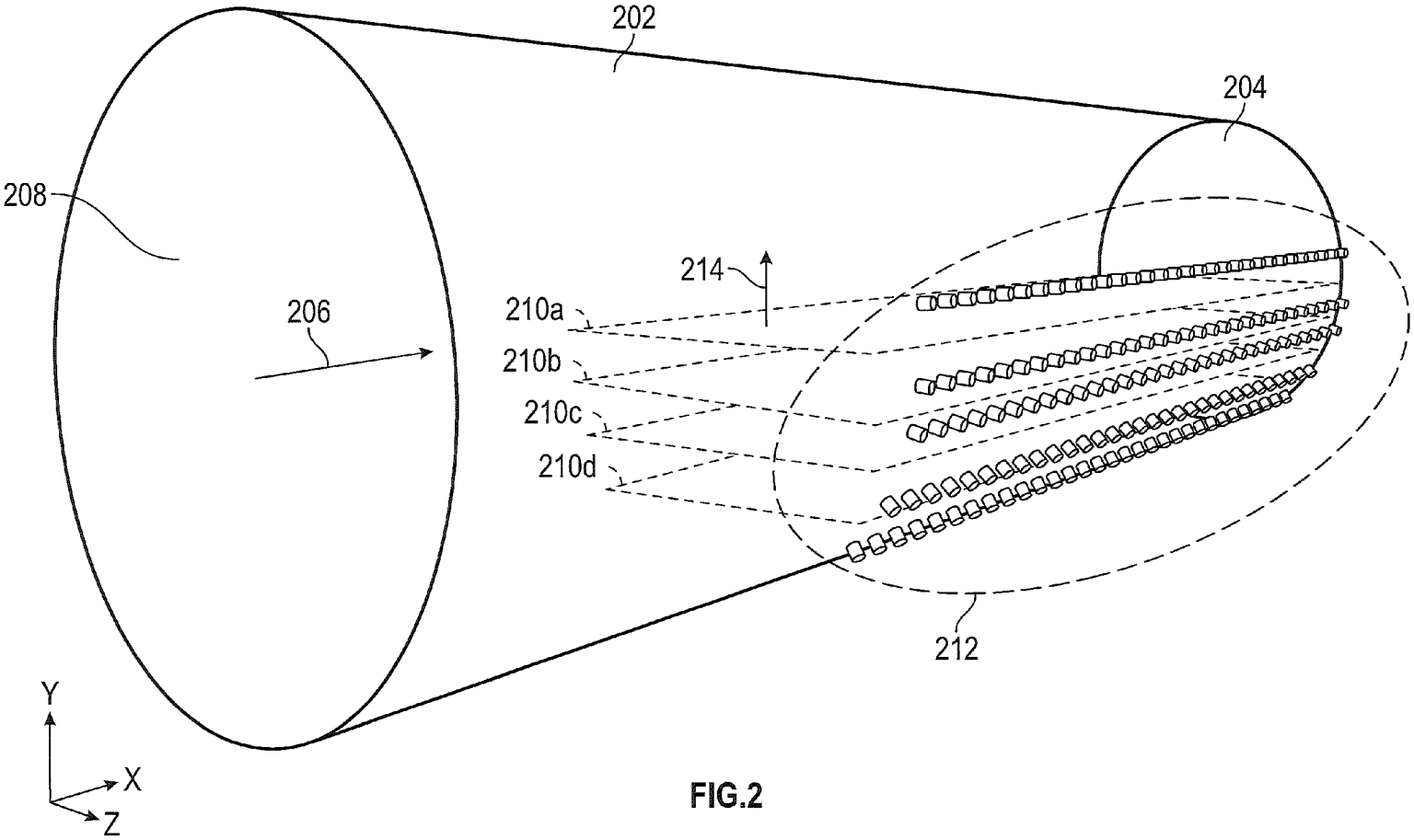
FIG. 2 illustrates a tube with horizontal plates in accordance with one or more aspects of this disclosure.

FIG. 2 illustrates a tube 202. The tube 202 may be associated with, or coupled to, a heat exchanger (not shown in FIG. 2). The tube 202 may be used to distribute one or more substances, such as refrigerant.

The tube 202 may include a closed-end 204. A flow 206 of, e.g., refrigerant may be inserted or injected into an open-end 208 of the tube 202, opposite the closed-end 204. As such, the flow 206 may traverse the tube 202 in a direction from an open-end 208 towards the closed-end 204.

The tube 202 may include one or more plates, such as plates 210*a*-210*d* as shown in FIG. 2. The plates 210*a*-210*d* may be arranged (substantially) parallel to one another as shown in FIG. 2. The plates 210*a*-210*d* may be arranged in a horizontal fashion or manner. For example, the plates may be aligned substantially along the x-z plane of the x, y, and z axes superimposed in FIG. 2. Thus, as shown in FIG. 2, the plates 210*a*-210*d* may be arranged in a horizontal fashion such that a normal 214 extending from a surface of the plates may be substantially perpendicular to the direction of the flow 206. For example, in some embodiments, the plates 210*a*-210*d* may be arranged such that the direction of gravity is normal to the plates 210*a*-210*d*.

Figure 3A:
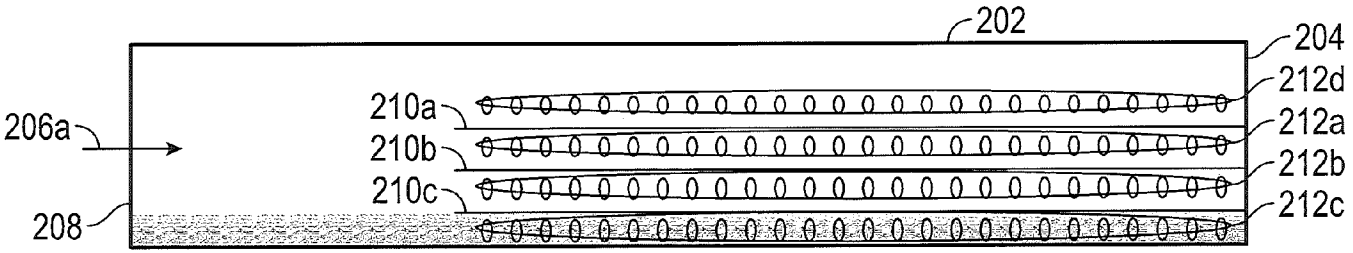
FIGS. 3A-3C illustrate horizontal plates for various liquid and vapor qualities in accordance with one or more aspects of this disclosure.
Figure 3B:
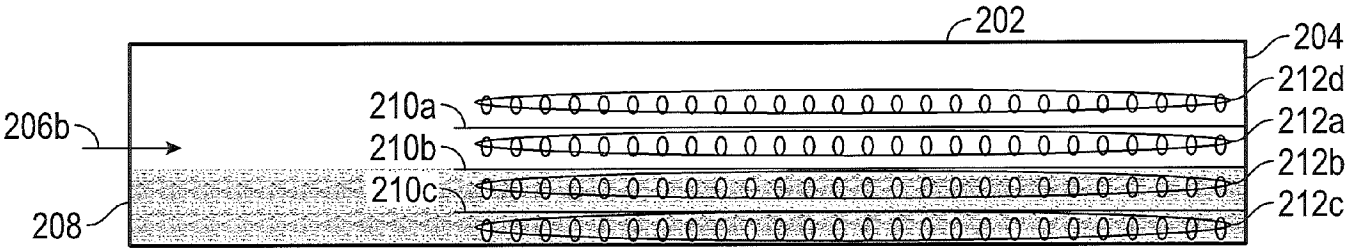
Figure 3C:
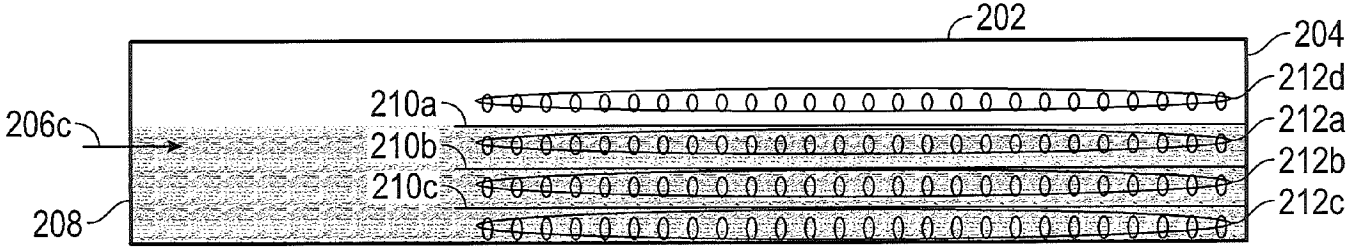

The plates 210*a*-210*d* are separated from one another by a gap in which there may exist a series of ports or holes 212. As shown in FIGS. 3A-3C (collectively referred to as FIG. 3), a first subset 212*a* of the holes is located between plates 210*a* and 210*b* and a second subset 212*b* of the holes 212 is located between the plates 210*b* and 210*c* (plate 210*d* is not shown in FIG. 3). One or more additional subsets of the holes 212, such as a subset 212*c* and a subset 212*d*, may be included.

The use of the plates 210 in connection with the tube 202 may be based on having a primarily stratified flow 206 in the tube 202. The plates 210 may partition the input flow 206 into a series of primarily single-phase layers. Such partitioning may be used to reduce a mal-distribution associated with two-phase flow. In practice, one or more layers may be two-phase in nature (e.g., a mixture of liquid and vapor). The degree of two-phase mixing that may be acceptable may be a function of the application or environment in which the tube 202 is used.

As shown in FIG. 3A, the subsets 212*a*, 212*b*, and 212*d* may primarily output vapor and the subset 212*c* may primarily output liquid, for example. In FIG. 3B, the subsets 212*a* and 212*d* may primarily output vapor and the subsets 212*b* and 212*c* may primarily output liquid. In FIG. 3C, the subset 212*d* may primarily output vapor and the subsets 212*a*, 212*b*, and 212*c* may primarily output liquid. More generally, the shaded layers or portions in FIG. 3 may be primarily indicative of liquid, whereas the non-shaded layers or portions may be primarily indicative of vapor.

In comparing FIGS. 3A-3C to one another, the differences in terms of the extent or degree of, e.g., vapor, in one instance (e.g., FIG. 3A) relative to another instance (e.g., FIG. 3C) may represent a flow 206 of different quality or characteristics. For example, a flow 206*a* associated with FIG. 3A may be different from (e.g., may tend to be composed of a greater degree of vapor relative to) a flow 206*b* of FIG. 3B and a flow 206*c* of FIG. 3C. Similarly, the flow 206*b* may be different from the flow 206*c* in terms of, e.g., liquid or vapor phase composition.

A selection in terms of the number of plates 210 and/or holes 212 to utilize may be a function of the application environment and the size of the tube 202. For example, a minimum number of plates 210 may be needed in order to obtain quality or good resolution (e.g., in order to obtain single-phase layers of the flow 206 within some threshold amount or quantity). On the other hand, maximizing the number of plates 210 may tend to increase manufacturing or fabrication costs. Accordingly, an appropriate balance may be obtained between resolution and cost based on the selection. The holes 212 may help to ensure that flow-rates are driven by single-phase distribution in each layer. Accordingly, the number of holes 212 used, such as the number of holes 212 in a given subset (e.g., subset 212*a*), may be selected to achieve a particular result.

Figure 4:
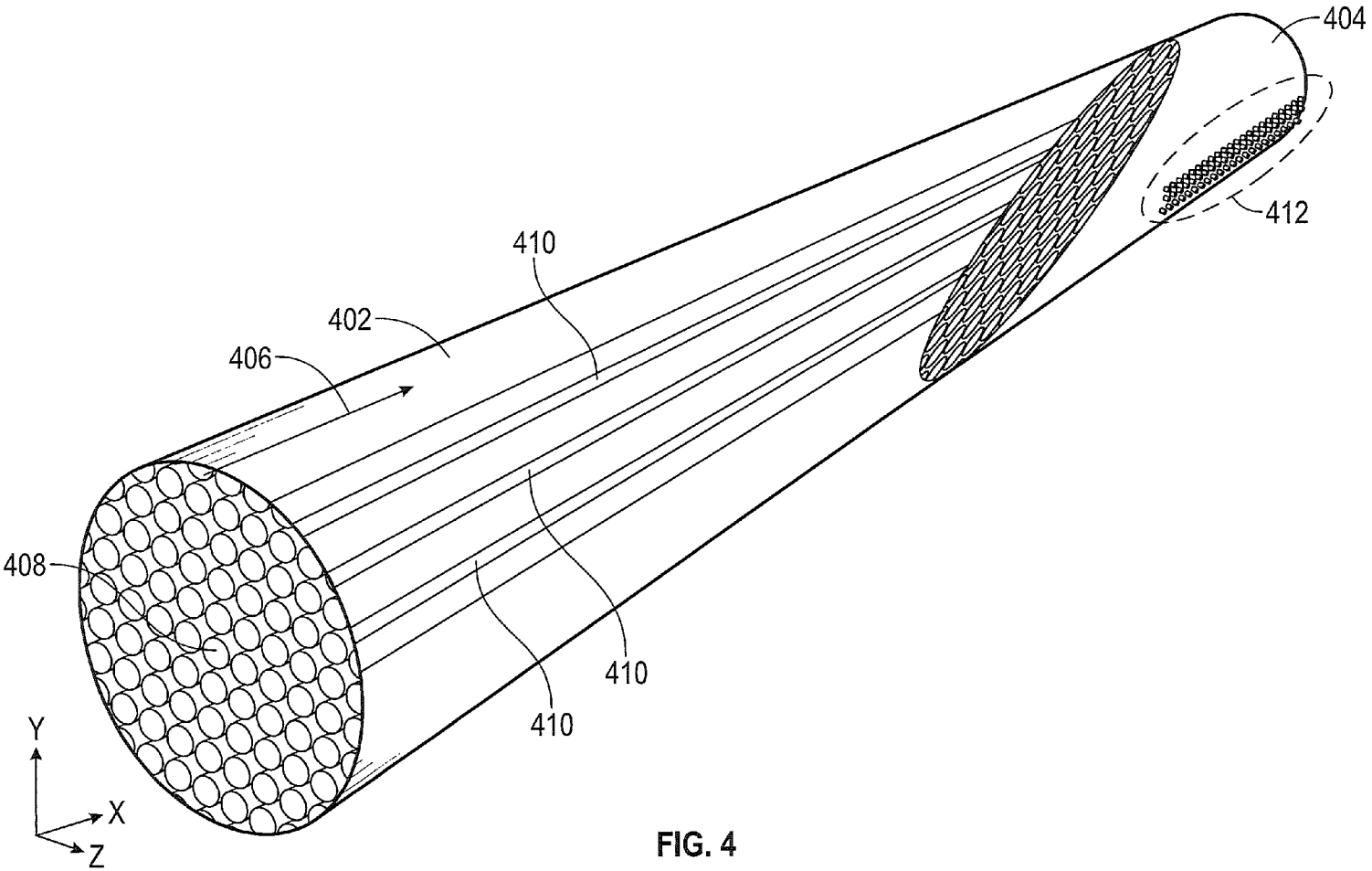
FIG. 4 illustrates a tube with channels in accordance with one or more aspects of this disclosure.

FIG. 4 illustrates a tube 402. In some embodiments, the tube 402 may be analogous to, or similar to, the tube 202 of FIGS. 2-3. The tube 402 may include a closed-end 404. The tube 402 may allow a flow 406 to be inserted or injected at an open-end 408 of the tube 402. The flow 406 may traverse the tube 402 in a direction from the open-end 408 towards the closed-end 404.

As shown in FIG. 4, the tube 402 may include a number of channels 410. The channels 410 may be arranged to be substantially parallel to one another. The channels 410 may take on a "straw-like" shape, form, or appearance. The channels 410 may convey the flow 406 in a direction from the open-end 408 towards the closed-end 404.

The use of the tube 402 (e.g., the channels 410) may be based on an assumption or condition that the input flow 406 to the tube 402 is relatively homogenous (e.g., is homogenous within a threshold). Such homogeneity in terms of the (input) flow 406 may be analogized to an output of a sprayer or mister, where the output may take on a "frothy" or "droplet" type of form or appearance. A homogenous flow 406 may occur as a result of the tube 402 being immediately downstream from an expansion device (not shown in FIG. 4), for example.

One or more of the channels 410 may be configured to uniformly and independently convey a portion of the flow 406 from the input or open-end 408 of the tube 402 to an output of the tube 402. For example, the output of the tube 402 may include one or more ports or holes 412 that may be configured to discharge the flow 406 from the tube 402.

The channels 410 may be configured to separate the input flow 406 into a series of smaller passages which may be cut at an angle with respect to a plane of the tube 402 in order to direct the flow 406 into the holes 412. In some embodiments, the ends of the channels 410 in proximity to the closed-end 404 may include a deflector plate (not shown in FIG. 4), which may be in a shape similar to the end or blade of a hockey stick. The deflector plate may be configured to turn or direct the flow 406 toward the holes 412 for discharge purposes.

The channels 410 may be used to effectively "lock-in" the flow 406 from the input or open-end 408 of the tube 402 until the flow 406 is discharged through the holes 412. In other words, uniformity may be enhanced, such that whatever type of flow (e.g., whatever mixture of liquid and vapor) is present at the input of a given channel 410 may be maintained through that channel 410 until exiting at the holes 412. In this respect, a mixing of the flow 406 across channels 410 may be prevented.

While the channels 410 are shown as being round in FIG. 4, different shapes for the channels 410 may be used in some embodiments. For example, different shapes or configurations for the channels 410, such as square, rectangular, and/or honeycomb configurations, may be used in some embodiments.

Figure 5:
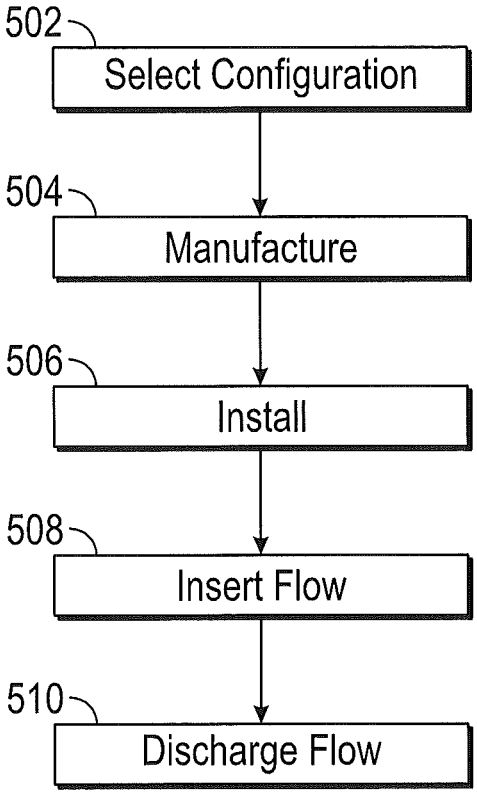
FIG. 5 illustrates an exemplary method in accordance with one or more aspects of this disclosure.

FIG. 5 illustrates a method that may be used to manufacture and utilize a distributor or tube, such as one or more of the tubes described above.

In step 502, a configuration for a tube may be selected. The configuration may be based on an environment or application in which the tube is to be used. For example, if an input flow is primarily stratified in nature, a tube comprising plates may be selected. If the input flow is homogenous in nature, a tube comprising channels may be selected. The number of plates or channels, as well as the number of discharge holes to use, may be selected in step 502.

In step 504, the tube may be manufactured. For example, the tube may be manufactured in accordance with the configuration or geometry selected in connection with step 502. One or more types of materials may be used to manufacture the tube and/or the plates/channels, such as iron, steel, copper, aluminum, composites, plastic, graphite, glass, etc. As part of step 504, an outer housing of the tube may be formed. As part of step 504, a plurality of substantially parallel plates within the outer housing may be formed to form a plurality of substantially parallel channels. Each channel may be configured to uniformly and independently convey a portion of a flow from an input of the outer housing to an output of the outer housing. In some embodiments, holes may be formed in between adjacent plates after the plates have been formed.

In step 506, the tube manufactured in accordance with step 504 may be installed in an application or environment in which the tube is to be used. For example, the tube may be installed or inserted in a heat exchanger application or environment.

In step 508, a flow may be inserted or input to the tube. For example, in a heat exchanger application the tube may convey or distribute refrigerant.

In step 510, the flow may be discharged from the tube. The discharged flow may be of a uniform distribution, which may result in improved application performance (e.g., improved heat exchanger performance). The flow may remain uniform over a wide range of flow conditions.

The steps shown in FIG. 5 are illustrative. In some embodiments, some of the steps (or portions thereof) may be optional. In some embodiments, additional steps not shown may be included. In some embodiments, the steps may execute in an order or sequence different from what is shown.

In some embodiments various functions or acts may take place at a given location and/or in connection with the operation of one or more apparatuses or systems. In some embodiments, a portion of a given function or act may be performed at a first device or location, and the remainder of the function or act may be performed at one or more additional devices or locations. Aspects of the disclosure may be directed to one or more systems, apparatuses, and methods.

Embodiments may be tied to particular machines. For example, in some embodiments a distributor or tube may include one or more plates or channels. The plates/channels may be of various configurations. For example, the plates/channels may be of various sizes, dimensions, or shapes. The number of separator plates/channels used in connection with a particular distributor or tube may be based on a particular environment or application in which the distributor or tube is used. The distributor or tube may include a number of ports or holes that may be configured to discharge a flow.

Embodiments may transform an article into a different state or thing. For example, in some embodiments an input two-phase flow may be distributed while preserving its characteristics (e.g., its phase or component characteristics) from an input end of a distributor or tube to an output end of the distributor or tube.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure.

What is claimed is:

1. A heat exchanger comprising:

a distributor comprising:

an outer housing and including a plurality of substantially parallel plates disposed within the housing and configured to partition an input two-phase flow into a series of primarily single-phase layers, the plates are arranged such that a normal extending from a surface of the plates is substantially perpendicular to a direction of the flow; and a plurality of holes through the outer housing, each hole defining a fluid path that extends from within the housing to an exterior surface of the outer housing to discharge flow from the distributor, wherein the fluid path extends perpendicular to the normal of the surface of the plates, and wherein the normal and the fluid paths are each substantially perpendicular to a direction of the flow.

2. The heat exchanger of claim 1, wherein the distributor comprises a closed-end opposite where the flow enters the distributor.

3. The heat exchanger of claim 2, wherein the plurality of holes are proximate the closed-end.

4. The heat exchanger of claim 1, wherein a first subset of the plurality of holes is located between a first plate of the plurality of plates and a second plate of the plurality of plates.

5. The heat exchanger of claim 1, wherein the distributor is configured to receive the input two-phase flow as a primarily stratified liquid phase and vapor phase.

* * * * *